US008985233B2

(12) United States Patent
Padilla

(10) Patent No.: US 8,985,233 B2
(45) Date of Patent: Mar. 24, 2015

(54) SYSTEM AND METHOD FOR CONTROLLING A ROTATION ANGLE OF A MOTOR GRADER BLADE

(75) Inventor: Christopher Padilla, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 76 days.

(21) Appl. No.: 13/335,157

(22) Filed: Dec. 22, 2011

(65) Prior Publication Data

US 2012/0160526 A1 Jun. 28, 2012

Related U.S. Application Data

(60) Provisional application No. 61/425,843, filed on Dec. 22, 2010.

(51) Int. Cl.
*E02F 3/76* (2006.01)
*E02F 3/84* (2006.01)

(52) U.S. Cl.
CPC ..... *E02F 3/845* (2013.01); *E02F 3/764* (2013.01); *E02F 3/7645* (2013.01); *E02F 3/765* (2013.01); *E02F 3/7654* (2013.01)
USPC ..... 172/4.5; 172/781; 172/795

(58) Field of Classification Search
USPC ..... 172/2, 4.5, 779–799
See application file for complete search history.

(56) References Cited

U.S. PATENT DOCUMENTS

| | | | | |
|---|---|---|---|---|
| 4,431,060 | A | 2/1984 | Scholl et al. | |
| 4,926,948 | A | 5/1990 | Davidson et al. | |
| 5,078,215 | A | 1/1992 | Nau | |
| 5,107,932 | A | 4/1992 | Zachman et al. | |
| 5,584,346 | A * | 12/1996 | Sakamoto et al. | 172/4.5 |
| 6,028,524 | A | 2/2000 | Hartman et al. | |
| 6,112,145 | A | 8/2000 | Zachman | |
| 6,129,156 | A | 10/2000 | Boast et al. | |
| 6,152,237 | A | 11/2000 | Hartman et al. | |
| 6,152,239 | A * | 11/2000 | Kelley et al. | 172/4.5 |
| 6,269,885 | B1 | 8/2001 | Barber et al. | |
| 6,389,345 | B2 * | 5/2002 | Phelps | 701/50 |
| 7,650,961 | B2 * | 1/2010 | Smith et al. | 180/338 |
| 7,712,559 | B2 | 5/2010 | Yeoman et al. | |
| 2006/0042804 | A1 | 3/2006 | Pecchio | |
| 2009/0056961 | A1 * | 3/2009 | Gharsalli et al. | 172/4.5 |
| 2010/0163259 | A1 | 7/2010 | Howson et al. | |

* cited by examiner

*Primary Examiner* — Matthew D Troutman
(74) *Attorney, Agent, or Firm* — Leonard Stewart

(57) ABSTRACT

The disclosure describes, in one aspect, a system and method for controlling a rotation angle of a blade of a motor grader having a front frame operatively coupled to a rear frame at a point defining an articulation angle between the front and rear frames. The control system includes at least one sensor operatively associated with the blade, at least one sensor operatively associated with a wheel, at least one sensor operatively associated with at least one of the front frame or the rear frame, and a controller operatively coupled to the at least one sensors. The controller is adapted to determine a current position of the blade, determine a wheel steering angle, determine an articulation angle, and control the rotation angle of the blade based in part on the wheel steering angle and the articulation angle.

12 Claims, 2 Drawing Sheets

SYSTEM AND METHOD FOR CONTROLLING A ROTATION ANGLE OF A MOTOR GRADER BLADE

RELATED APPLICATION

This application is based upon and claims the benefit of priority from U.S. Provisional Application No. 61/428,843 by Christopher A. Padilla, filed Dec. 22, 2010, the contents of which are expressly incorporated herein by reference.

TECHNICAL FIELD

This patent disclosure relates generally to blade control systems, and more particularly, to systems and methods for controlling a rotation angle of a motor grader blade.

BACKGROUND

Motor graders are used primarily as a finishing tool to sculpt a surface of the earth to a final arrangement. Typically, motor graders include many manual controls or input devices to steer the motor grader, position a blade, and/or articulate a frame of the motor grader. The operator may use the input devices, such as, for example, hand levers to manually adjust the motor grader. A motor grader is adjusted, for example, to an articulation angle by rotating the front frame relative to a rear frame. The operator may adjust the articulation angle while performing other tasks, such as, for example, repositioning the blade and steering.

Controlling the many control input devices may require a highly skilled operator. The blade, for example, is adjustably mounted to a front frame of the motor grader to move relatively small quantities of earth from side to side. Even with a skilled operator, manual control of the blade to accomplish earthmoving tasks, particularly finish work such as finish grading, is not always accurate and can require multiple trials to achieve a desired result. This duplication of work may be inefficient, time consuming, costly, and fatiguing to the operator. To increase efficiency and allow the operator to concentrate on important operational tasks, it is desirable to provide a system and method for automatically controlling the rotation angle of the blade of a motor grader.

The present disclosure is directed to overcome one or more of the problems as set forth above.

SUMMARY

The disclosure describes, in one aspect, a system and method for controlling a rotation angle of a blade of a motor grader having a front frame operatively coupled to a rear frame at a point defining an articulation angle between the front and rear frames. The control system includes at least one sensor operatively associated with the blade, at least one sensor operatively associated with a wheel, at least one sensor operatively associated with at least one of the front frame or the rear frame, and a controller operatively coupled to the at least one sensors. The controller is adapted to determine a current position of the blade, determine a wheel steering angle, determine an articulation angle, and control the rotation angle of the blade based in part on the wheel steering angle and the articulation angle.

BRIEF DESCRIPTION OF THE DRAWING(S)

DETAILED DESCRIPTION

Figure 1:
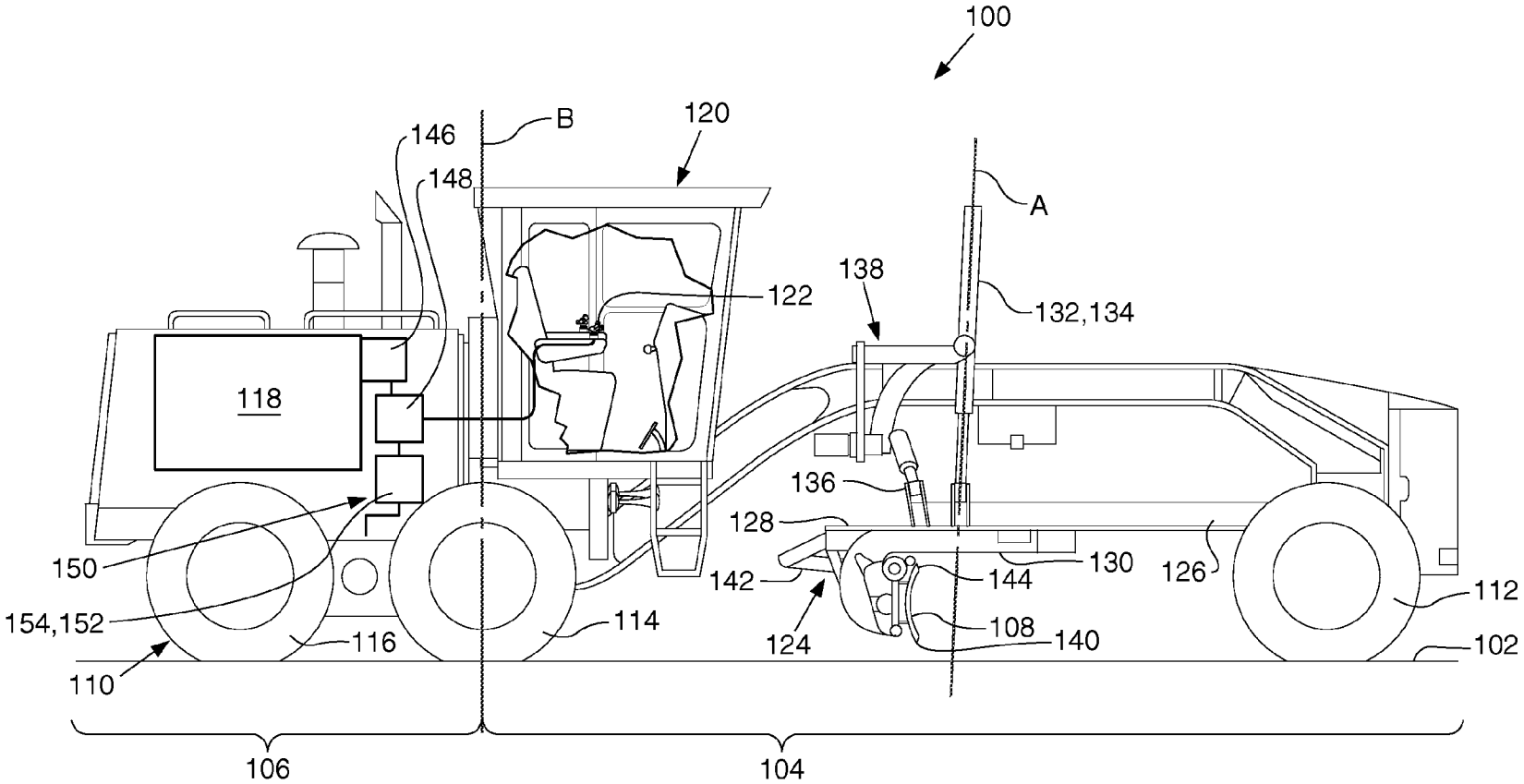
FIG. 1 is a diagrammatic side elevational view of a motor grader having a control system in accordance with an exemplary embodiment of the present disclosure.

This disclosure relates to systems and methods for automatically controlling a rotation angle of a motor grader blade. An exemplary embodiment of a motor grader 100 is generally shown in FIG. 1, may perform some type of operation associated with an industry such as mining, construction, farming, transportation, or any other industry known in the art. The motor grader 100 is generally used as a finishing tool to alter a surface of terrain or earth 102 to a final arrangement or contour. In an illustrated embodiment, the motor grader 100 includes a front frame 104, a rear frame 106, and a blade 108. The front 104 and rear 106 frames are supported by wheels 110, which include a pair of front wheels 112 and two pairs of rear wheels 114, 116 (only one side shown).

In the illustrated embodiment, the motor grader 100 further includes a power source such as an engine 118, an operator station or cab 120 containing controls necessary to operate the motor grader 100, such as, for example, input devices 122 for propelling the motor grader 100 and/or for controlling the blade 108 for moving earth 102 and/or for controlling other machine components. The input devices 122 may include one or more devices embodied as a joystick disposed within the cab 120 and may be adapted to receive input from an operator indicative of a desired blade 108 or motor grader 100 movement. The cab 120 is mounted on the front frame 104.

The engine 118 may power a drive system (not shown) that may include the front wheels 112 and the rear wheels 114, 116 adapted to support the motor grader 100. The wheels 110, 112, 114, 116 may be adapted for steering and maneuvering the motor grader 100 and for propelling the motor grader 100 in forward and reverse directions. The front wheels 112 may be adapted to turn relative to the front frame 104 to steer the motor grader 100. The angle formed between the direction of the front wheels 112 and the front frame 104 establishes a wheel steering angle. For example, when the front wheels 112 are facing forward, and the motor grader 100 is not articulated, the wheel steering angle is zero. Any pivoting by the wheels 112 relative to the front frame 104 increases the wheel steering angle by an amount that may be proportionate to the amount of pivoting of the front wheels 112.

The engine 118 may embody, for example, a diesel engine, a gasoline engine, a gaseous fuel-powered engine, or any other type of combustion engine known in the art. It is contemplated that the power source 118 may alternatively embody a non-combustion source of power (not shown) such as, for example, a fuel cell, a power storage device, or another suitable source of power. The engine 118 may produce a mechanical or electrical power output that may be converted to hydraulic power. The engine 118 is mounted on the rear frame 106.

In some embodiments, the blade 108 is operatively coupled to a drawbar/moldboard/circle (DMC) assembly 124, which includes a drawbar 126, a moldboard 128, and a circle 130. The position of the drawbar 126 may be controlled by hydraulic cylinders coupled to the front frame 104, such as, for example, a pair of lift cylinders 132, 134 (a right lift cylinder and a left lift cylinder respectively) and a shift cylinder 136. The lift cylinders 132, 134 may be controlled independently, for example, to angle a bottom edge or cutting edge 140 of the blade 108 relative to the surface of the earth 102. The shift cylinder 136 may be controlled to side shift the drawbar 124.

The lift cylinders 132, 134 and shift cylinder 136 are coupled to the front frame using a moveable coupling 138 that may be moved during repositioning of the blade 108 but that is fixed stationary during earthmoving operations.

The blade 108 may be coupled to the circle 130 and the circle 130 may be rotatably coupled to the moldboard 128. The moldboard 128 may be coupled to the drawbar 126, which may be coupled to the front frame 104 of the motor grader 100. In some embodiments, the blade 108 may be fixedly coupled to the circle 130. The circle 130 may rotate about an axis A, which may, in turn, cause the blade 108 to rotate about the axis A. The circle 130 is rotated by a hydraulic motor or circle drive (not shown).

In some embodiments, the blade 108 may be adjusted in several degrees of freedom relative to the motor grader 100. The rotation of the blade 108 about the axis A may result in a change in a rotation angle of the blade 108 relative to a direction of travel of the motor grader 100. Rotating the blade 108 about the axis A establishes a blade cutting angle, which may be defined as the rotation angle of the blade 108 relative to the front frame 104 and relative to the direction of travel of the motor grader 100. At a zero degree cutting or rotation angle, the blade 108 is aligned at a right angle to the front frame 104 and orthogonal to or perpendicular to the direction of travel of the motor grader 100.

In addition to rotating about axis A, the blade 108 may be tilted forward and backward. The blade 108 is hingeably coupled to the circle 130, which allows the blade 108 to be moveable forward and backward. A tip cylinder 142 is used to move a top edge 144 of the blade 108 ahead of or behind the bottom cutting edge 140 of the blade 108. The position of the tip edge of the blade 108 relative to the bottom cutting edge 140 is commonly referred to as a blade 108 tip.

In addition, the blade 108 may be slidably coupled to the circle 130 to permit movement of the blade 108 from side to side relative to the circle 130, referred to as a blade 108 side shift. A side shift cylinder (not shown) controls the blade 108 side shift. Further, the blade 108 may be raised or lowered to adjust a height of the blade 108 relative to the surface of the earth 102. Still further, the blade 108 may be adjusted so as to change a slope of the blade 108. Blade 108 height may be primarily controlled by the lift cylinders 132, 134.

The motor grader 100 may further include articulation cylinders (not shown) coupled to each side of the rear frame 106. An articulation joint connects the front frame 104 to the rear frame 106 at axis B. The articulation cylinders may be used to rotate the front frame 104 about the articulation axis B. As shown in FIG. 1, the motor grader 100 is in a neutral or zero articulation angle position. A suitable sensor, such as, for example, a rotary sensor or other displacement sensor 146, may be used to measure an articulation angle at the articulation joint. Movement of the front frame 104 relative to the rear frame 106 establishes the articulation angle. The motor grader 100 may be operated with the front frame 104 102 rotated to a full or maximum right articulation angle, a full or maximum left articulation angle, or any angle between the full right and full left articulation angles.

The motor grader 100 may further include a control system 148 operatively connected to the input device 122 and to the hydraulic cylinders 132, 134, 136, 142 for controlling, for example, movement of the blade 108 or the articulation angle of the front frame 104, and other hydraulic actuators. In some embodiments, the control system 148 may be operatively connected to the input device 122 and to other motor grader 100 components for controlling other operations of the motor grader 100, such as, for example, operatively connected to the wheels 110 for controlling a speed of the motor grader 100.

The control system 148 may direct the blade 108 to move to a predetermined or target position in response to an operators' desired movement of the blade 108 for engaging the blade 108 with the terrain of the earth 102. The control system 148 may further direct the blade 108 to move to a predetermined or target position indicative of an automatically determined movement of the blade 108, based in part on, for example, an engineering or site design, a map, a productivity measure, or a combination of site design and productivity measure.

For precise control, such as, for example, to direct the blade 108 to move precisely in response to an automatically determined movement signal or command, the control system 148 may require certain predetermined or acquired data associated with the motor grader 100, such as, for example, the articulation angle of the motor grader 100. The control system 148 may include one or more sensors 150 operatively connected to or associated with the motor grader 100 for determining certain operational characteristics, such as, for example, the wheel steering angle of the motor grader 100 or the rotation angle of the blade 108. The one or more sensors 150 may embody position sensors 152 associated with each hydraulic actuator, cylinder, and motor such as the lift cylinders 132, 134, shift cylinder 136, and the circle drive motor.

The control system 148 may be adapted to receive inputs from the input device 122 and the sensors 146, 150. The control system 148 is further adapted to control or direct the movement of the blade 108 based at least in part on the inputs from the input device 122 and the sensors 146, 150. The position sensors 152 provide information to the control system 148 associated with its respective hydraulic actuator, cylinder, and motor. Consequently, the control system 148 can determine a position of the blade 108. In addition, the control system 148 receives articulation information from the rotary sensor 146.

Alternatively, or additionally, the one or more sensors 150 may embody at least one wheel angle sensor 154 associated with at least one of the front wheels 112 and may be adapted to monitor the front wheels 112 to determine the wheel steering angle. In some embodiments, the wheel angle sensor monitors the wheel steering angle. In other embodiments, the wheel angle sensor monitors the angles of steering linkages associated with the front wheels 112 or the extension amount of an actuator, such as, for example, a hydraulic actuator (not shown) that controls steering. The wheel angle sensor 154 may be located at any of number of different positions where it can monitor the amount of turn of a front wheel 112 or sense movement of the input device 122 indicative of a desired turn. With blade 108 position, articulation angle, the wheel steering angle information, and other such information associated with operations of the motor grader 100, the control system 148 may control motor grader 100 operations as discussed above.

The control system 148 may include one or more control modules (e.g. ECMs, ECUs, etc.). The one or more control modules may include processing units, memory, sensor interfaces, and/or control signal interfaces (for receiving and transmitting signals). The processing units may represent one or more logic and/or processing components used by the control system 148 to perform certain communications, control, and/or diagnostic functions. For example, the processing units may be adapted to execute routing information among devices within and/or external to the control system 148.

Further, the processing units may be adapted to execute instructions, including from a storage device, such as memory. The one or more control modules may include a plurality of processing units, such as one or more general purpose processing units and or special purpose units (for example, ASICS, FPGAs, etc.). In certain embodiments, functionality of the processing unit may be embodied within an integrated microprocessor or microcontroller, including integrated CPU, memory, and one or more peripherals. The memory may represent one or more known systems capable of storing information, including, but not limited to, a random access memory (RAM), a read-only memory (ROM), magnetic and optical storage devices, disks, programmable, erasable components such as erasable programmable read-only memory (EPROM, EEPROM, etc.), and nonvolatile memory such as flash memory.

INDUSTRIAL APPLICABILITY

The industrial applicably of the systems and methods for automatically controlling a rotation angle of a motor grader blade described herein will be readily appreciated from the foregoing discussion. Although shown as a motor grader, any type of machine that performs at least one operation associated with, for example, mining, construction, and other industrial applications may embody the disclosed systems and methods. The machine may also be associated with non-industrial uses and environments, such as, for example, cranes, earthmoving vehicles, backhoes, and/or material handling equipment. Moreover, the systems and methods described herein can be adapted to a large variety of machines and tasks.

Figure 2:
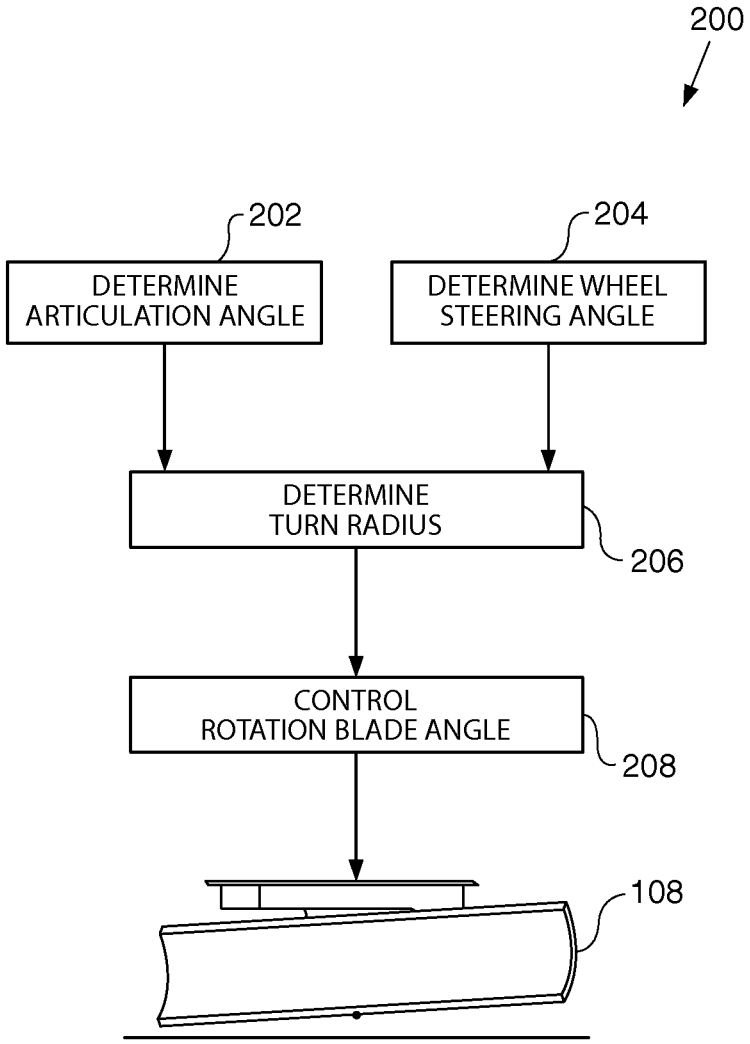
FIG. 2 is a flow diagram illustrating one embodiment of a control process for controlling a rotation angle of a blade of a motor grader in accordance with an exemplary embodiment of the present disclosure.

As discussed, one exemplary motor grader suited to the disclosure includes a control system 148 that is adapted or configured to generate a desired or optimal blade rotation angle and/or control the position of the blade to achieve the desired or optimal blade rotation angle based in part on the articulation angle and the wheel steering angle. In accordance with certain embodiments, FIG. 2 illustrates an exemplary embodiment of the control system 148 and the process of automatically controlling the rotation angle of a motor grader blade (200).

The control system 148 is adapted to receive articulation angle information from the rotary sensor 146 associated with the front 104 and rear 106 frames (Step 202). The control system 148 is further adopted to received wheel steering angle information from a wheel angle sensor 154 associated with at least one of the front wheels 112 of the motor grader 100 (Step 204). In some embodiments, the control system 148 may determine a turn radius based in part on the wheel steering angle and the articulation angle (Step 206). In the illustrated embodiment, the control system 148 controls the rotation angle of the blade 108 based in part on the articulation angle and the wheel steering angle (Step 208).

In some embodiments, the optimal rotation angle of the blade 108 may be embodied in a table that correlates the optimal rotation angle with the combination of articulation angle information and wheel steering angle information. In some embodiments, the control system 148 may incorporate other information associated with the operation of the motor grader 100 to determine a current turn radius, such as, for example, a wheel lean angle. Further, additional information associated with the characteristics of the motor grader 100, such as, for example, machine dimensions or blade length, or information associated with the application, such as, for example finish grade for a cul-de-sac, may be used to determine the optimal rotation angle of the blade 108 of the motor grader 100. The optimal rotation angle of the motor grader 100 blade 108 may be associated with sending material to an ideal location outside of the turn radius of the motor grader 100 with less rework or fewer grading cycles.

It will be appreciated that the foregoing description provides examples of the disclosed systems and methods. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A blade control system for a motor grader, the control system comprising:

a first sensor adapted to receive a signal indicative of an articulation angle of the motor grader;

a second sensor adapted to receive a signal indicative of a wheel steering angle of the motor grader;

a controller operatively connected to a blade of the motor grader; the controller configured to:

determine the articulation angle from the first sensor;

determine the wheel steering angle from the second sensor;

determine a desired blade rotation angle based in part on the wheel steering angle and the articulation angle, the blade rotation angle is the angle relative to a front frame of the motor grader and the direction of travel of the motor grader; and control the blade based in part on the desired blade rotation angle.

2. The blade control system of claim 1, further comprising:

a third sensor adapted to receive a signal indicative of a position of the blade.

3. The blade control system of claim 2, wherein the controller is further configured to:

determine a current position of the blade based on the third sensor;

determine the desired blade rotation angle based also in part on the current position of the blade; and control the blade based in part on the desired blade rotation angle.

4. The blade control system of claim 1, wherein the first sensor is a rotary sensor associated with a front frame of the motor grader and a rear frame of the motor grader, and the articulation angle is defined by the relative movement of the front frame and the rear frame.

5. The blade control system of claim 1, wherein the second sensor is a wheel angle sensor associated with at least one front wheel of the motor grader.

6. The blade control system of claim 5, wherein determining the wheel steering angle includes monitoring the at least one front wheel, and the wheel steering angle is defined by an angle formed between a direction of the at least one front wheel and a front frame of the motor grader.

7. The blade control system of claim 5, wherein determining the wheel steering angle includes monitoring at least one steering linkage associated with the at least one front wheel.

8. The blade control system of claim 2, further comprising:

a fourth sensor adapted to receive a signal from an input device indicative of an intended turn of the motor grader.

9. The blade control system of claim 8, wherein determining the wheel steering angle is a function of the intended turn signal from the input device.

10. The blade control system of claim 1, wherein the controller is further configured to:

determine a turn radius based in part on the wheel steering angle and the articulation angle;

determine the desired blade rotation angle based also in part on the turn radius; and control the blade based in part on the desired blade rotation angle.

11. The blade control system of claim 10, wherein determining the desired blade rotation angle is based also in part on a current turn radius.

12. The blade control system of claim 10, wherein determining the desired blade rotation angle is based also in part on at least one of a motor grader dimension, a blade length, a motor grader operation, or a motor grader application.

* * * * *